US010276983B2

(12) United States Patent
Arai et al.

(10) Patent No.: US 10,276,983 B2
(45) Date of Patent: Apr. 30, 2019

(54) CONNECTOR AND METHOD OF FABRICATING THE SAME

(71) Applicant: Japan Aviation Electronics Industry, Limited, Tokyo (JP)

(72) Inventors: Katsumi Arai, Tokyo (JP); Yuichi Saito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/739,823

(22) PCT Filed: Jun. 22, 2016

(86) PCT No.: PCT/JP2016/068473

§ 371 (c)(1),
(2) Date: Dec. 26, 2017

(87) PCT Pub. No.: WO2017/022355

PCT Pub. Date: Feb. 9, 2017

(65) Prior Publication Data

US 2018/0191102 A1 Jul. 5, 2018

(30) Foreign Application Priority Data

Jul. 31, 2015 (JP) ..... 2015-151912

(51) Int. Cl.
*H01R 13/648* (2006.01)
*H01R 13/6585* (2011.01)
(Continued)

(52) U.S. Cl.
CPC ..... *H01R 13/6585* (2013.01); *H01R 13/639* (2013.01); *H01R 24/60* (2013.01);
(Continued)

(58) Field of Classification Search
CPC ..... H01R 23/02; H01R 24/60; H01R 24/62; H01R 13/652; H01R 13/6594; H01R 13/6587
(Continued)

(56) References Cited

U.S. PATENT DOCUMENTS 8,968,031 B2 * 3/2015 Simmel ..... H01R 13/659 439/660
9,281,626 B2 * 3/2016 Lin ..... H01R 13/6581
(Continued)

FOREIGN PATENT DOCUMENTS

CN 102142627 B 8/2011
CN 203859329 U 10/2014
(Continued)

OTHER PUBLICATIONS

International Search Report of PCT/JP2016/068473, dated Sep. 20, 2016.
(Continued)

*Primary Examiner* — Hien D Vu
(74) *Attorney, Agent, or Firm* — Collard & Roe, P.C.

(57) ABSTRACT

A connector comprises a holding member, a plurality of terminals and a conductive member. Each of the terminals has a contact portion. The contact portions of the terminals are arranged in two rows along the pitch direction. The conductive member is held by the holding member. The conductive member has a first portion and two second portions. The first portion has a plate-like shape. The first portion has two first engagement portions. Each of the second portions has a second engagement portion. In the perpendicular direction, the second engagement portion has a size different from a size of the first engagement portion. One of the first engagement portion and the second engagement portion is recessed in the mating direction. A remaining
(Continued)

one of the first engagement portion and the second engagement portion protrudes in the mating direction and is received in the one of the first engagement portion and the second engagement portion.

10 Claims, 16 Drawing Sheets

(51) Int. Cl.

| | |
|---|---|
| ***H01R 24/60*** | (2011.01) |
| ***H01R 43/24*** | (2006.01) |
| ***H01R 13/639*** | (2006.01) |
| *H01R 13/6594* | (2011.01) |
| *H01R 13/66* | (2006.01) |
| *H01R 107/00* | (2006.01) |
| *H01R 13/405* | (2006.01) |

(52) U.S. Cl.
CPC ..... *H01R 43/24* (2013.01); *H01R 13/405* (2013.01); *H01R 13/6594* (2013.01); *H01R 13/6658* (2013.01); *H01R 2107/00* (2013.01)

(58) Field of Classification Search
USPC ..... 439/660, 607.4, 607.35, 108
See application file for complete search history.

(56) References Cited

U.S. PATENT DOCUMENTS

| | | | | |
|---|---|---|---|---|
| 9,306,336 | B2 | 4/2016 | Chang et al. | |
| 9,437,980 | B2 * | 9/2016 | Ueda | H01R 13/6596 |
| 9,728,885 | B2 * | 8/2017 | Yokoyama | H01R 13/42 |
| 2015/0044886 | A1 | 2/2015 | Little et al. | |
| 2015/0171573 | A1 | 6/2015 | Little et al. | |
| 2015/0214674 | A1 | 7/2015 | Simmel et al. | |
| 2015/0295362 | A1 | 10/2015 | Tziviskos et al. | |
| 2016/0020572 | A1 | 1/2016 | Ju et al. | |

FOREIGN PATENT DOCUMENTS

| | | | |
|---|---|---|---|
| CN | 204179385 | U | 2/2015 |
| CN | 104466592 | A | 3/2015 |
| CN | 204304072 | U | 4/2015 |
| CN | 204304075 | U | 4/2015 |
| CN | 204315752 | U | 5/2015 |
| JP | 3198301 | U | 6/2015 |
| TW | M512232 | U | 11/2015 |

OTHER PUBLICATIONS

Extended European Search Report in EP 16832634.6, dated Jun. 11, 2018.
Chinese Office Action in CN 201680041171.6, dated Jan. 8, 2019, with English translation.

* cited by examiner

CONNECTOR AND METHOD OF FABRICATING THE SAME

CROSS REFERENCE TO RELATED APPLICATIONS

This application is the National Stage of PCT/JP2016/068473 filed on Jun. 22, 2016, which claims priority under 35 U.S.C. § 119 of Japanese Application No. 2015-151912 filed on Jul. 31, 2015, the disclosure of which is incorporated by reference. The international application under PCT article 21(2) was not published in English.

TECHNICAL FIELD

This invention relates to a connector which comprises a plurality of terminals and a conductive member and which is configured so that contact portions of the terminals are arranged in two rows and that the conductive member is arranged between the contact portions of the two rows. Moreover, this invention relates to a method of fabricating the connector.

BACKGROUND ART

Paten Document 1 discloses a connector of this type. Referring to FIGS. 29 to 31, a connector 900 of Patent Document 1 comprises a holding member 910, a plurality of terminals 920 and a conductive member 930. The holding member 910 holds the terminals 920 and the conductive member 930. The holding member 910 is provided with a tongue portion 912. Each of the terminals 920 has a contact portion 922. The contact portions 922 are arranged in two rows in a Y-direction. Each of the contact portions 922 is partially exposed outside the tongue portion 912 in a Z-direction. The conductive member 930 has a plate-like first portion 932 and second portions 934 which are positioned at opposite ends, respectively, of the first portion 932 in the Y-direction. The conductive member 930 is partially embedded in the holding member 910 via insert-molding. The first portion 932 is positioned between the contact portions 922 of the two rows in the Z-direction. Each of the second portions 934 is exposed outside the tongue portion 912 in the Y-direction.

PRIOR ART DOCUMENTS

Patent Document(s)

Patent Document 1: JPU 3198301

SUMMARY OF INVENTION

Technical Problem

In order to obtain good electrical characteristics, it is preferable that the first portion 932 is arranged in a balanced manner with respect to the contact portions 922 of the two rows. However, due to manufacturing accuracy of the second portion 934, the second portion 934 may have variations in shape and size, and the conductive member 930 may have variations in relative position between the first portion 932 and each of the second portions 934. Accordingly, the connector 900 of Patent Document 1 has a drawback that the first portion 932 may not be arranged in a balanced manner with respect to the contact portions 922 of the two rows.

It is therefore an object of the present invention to provide a connector enabling a first portion, which has a plate-like shape, to be arranged in a balanced manner with respect to contact portions of two rows.

Solution to Problem

An aspect of the present invention provides a connector mateable with a mating connector along a mating direction. The connector comprises a holding member, a plurality of terminals and a conductive member. The holding member has a tongue portion which extends in both a pitch direction and the mating direction, the pitch direction being perpendicular to the mating direction. Each of the terminals is held by the holding member. Each of the terminals has a contact portion. The contact portions of the terminals are arranged in two rows along the pitch direction. The contact portion of each of the terminals is, at least in part, exposed outside the tongue portion in a perpendicular direction perpendicular to both the mating direction and the pitch direction. The conductive member is held by the holding member. The conductive member has a first portion and two second portions, the first portion having a plate-like shape. The second portions are positioned at opposite ends, respectively, of the first portion in the pitch direction. The first portion is positioned between the contact portions of the two rows in the perpendicular direction. The first portion has two first engagement portions. Each of the second portions is partially exposed outside the tongue portion in the pitch direction. Each of the second portions has a second engagement portion. The second engagement portions are engaged with the first engagement portions, respectively. In the perpendicular direction, the second engagement portion has a size different from a size of the first engagement portion. One of the first engagement portion and the second engagement portion is recessed in the mating direction. A remaining one of the first engagement portion and the second engagement portion protrudes in the mating direction and is received in the one of the first engagement portion and the second engagement portion.

Another aspect of the present invention provides a method of fabricating a connector. The method comprises: a step of preparing a conductive member having a first portion and two second portions, the first portion having a plate-like shape, the first portion intersecting with a perpendicular direction, the first portion having two first engagement portions, the second portions being positioned at opposite ends, respectively, of the first portion in a pitch direction perpendicular to the perpendicular direction, each of the second portions having a second engagement portion, in the perpendicular direction, the second engagement portion having a size different from a size of the first engagement portion, one of the first engagement portion and the second engagement portion being recessed in a mating direction perpendicular to both the perpendicular direction and the pitch direction, a remaining one of the first engagement portion and the second engagement portion protruding in the mating direction and being received in the one of the first engagement portion and the second engagement portion, the second engagement portions being engaged with the first engagement portions, respectively, so as to regulate a movement of the first portion relative to each of the second portions in the pitch direction while allowing a movement of the first portion relative to each of the second portions in the perpendicular direction; a step of positioning the first portion and the second portions by the conductive member being set in metal molds so that the metal molds sandwich each of the first portion and the second portions therebetween; and a step of pouring a resin in the metal molds to mold the resin so that the holding member is formed while the holding member holds the conductive member.

Advantageous Effects of Invention

The one of the first engagement portion and the second engagement portion is recessed in the mating direction, while the remaining one of the first engagement portion and the second engagement portion protrudes in the mating direction. In addition, the one of the first engagement portion and the second engagement portion receives the remaining one of the first engagement portion and the second engagement portion. Accordingly, even in a state before the conductive member is held by the holding member, a relative movement of the first portion with respect to each of the second portions is regulated. Thus, the conductive member can be held by the holding member under a state where each of the second portions is positioned with respect to the first portion.

In the perpendicular direction, the second engagement portion has the size different from the size of the first engagement portion. Specifically, in the perpendicular direction, one of the first engagement portion and the second engagement portion is larger than a remaining one of the first engagement portion and the second engagement portion. Accordingly, when the conductive member is held by the holding member, the first portion can be relatively moved with respect to each of the second portions in the perpendicular direction while the engagements of the first engagement portions and the second engagement portions are maintained. Thus, the first portion can be positioned at an appropriate position in the perpendicular direction in the holding member, so that the first portion can be arranged in a balanced manner with respect to the contact portions of the two rows.

An appreciation of the objectives of the present invention and a more complete understanding of its structure may be had by studying the following description of the preferred embodiment and by referring to the accompanying drawings.

DESCRIPTION OF EMBODIMENTS

Figure 1:
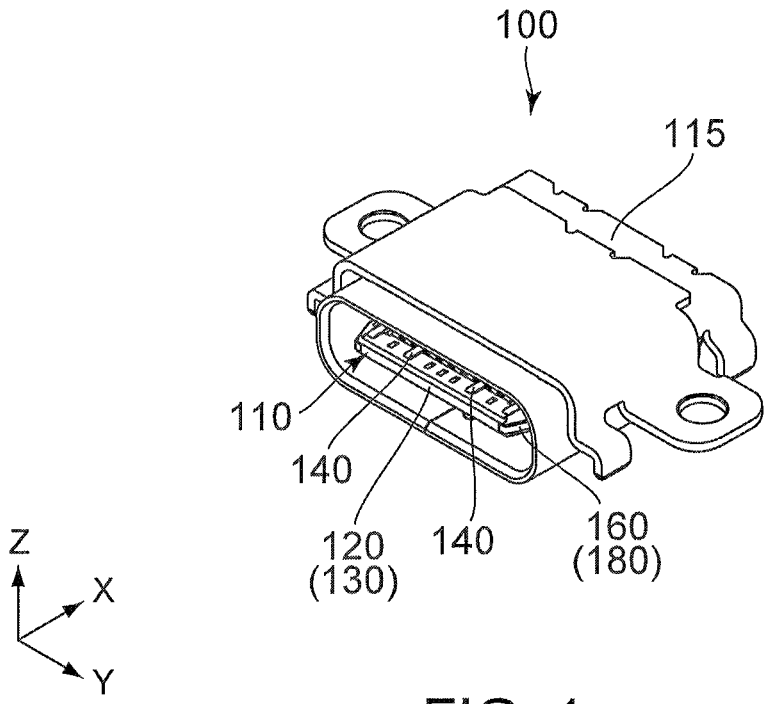
FIG. 1 is a perspective view showing a connector according to a first embodiment of the present invention.
Figure 2:
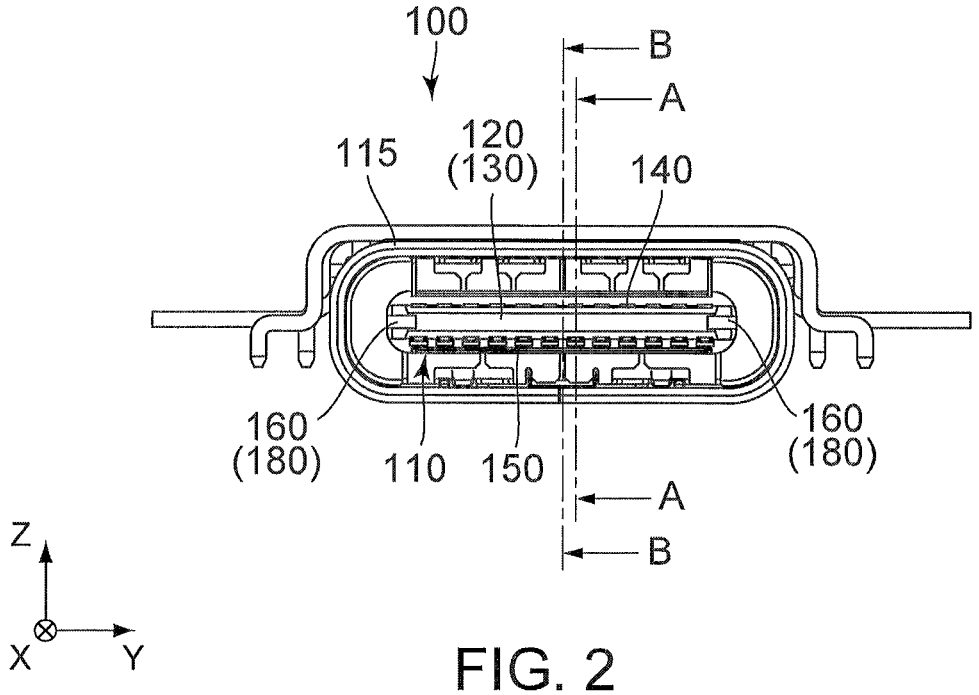
FIG. 2 is a front view showing the connector of FIG. 1.
Figure 3:
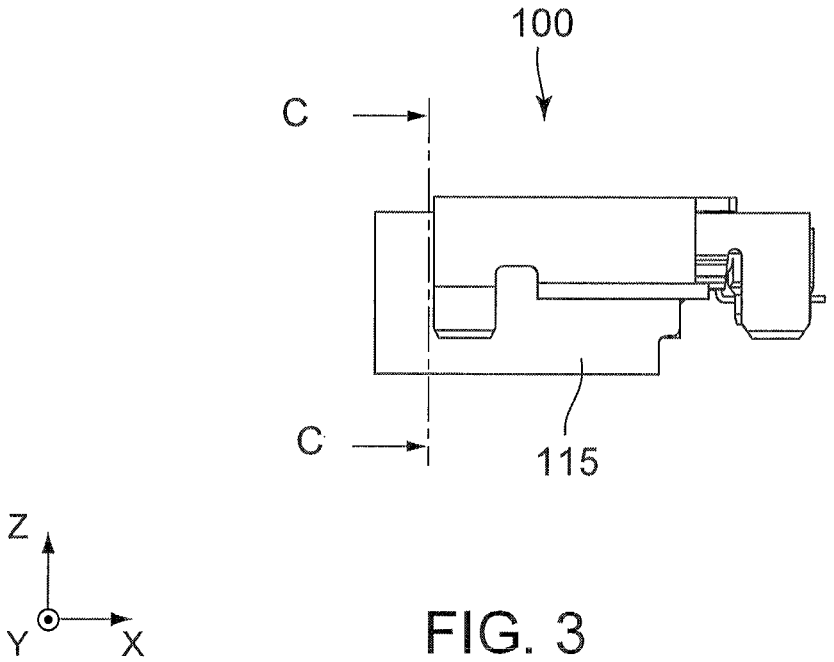
FIG. 3 is a side view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 13:
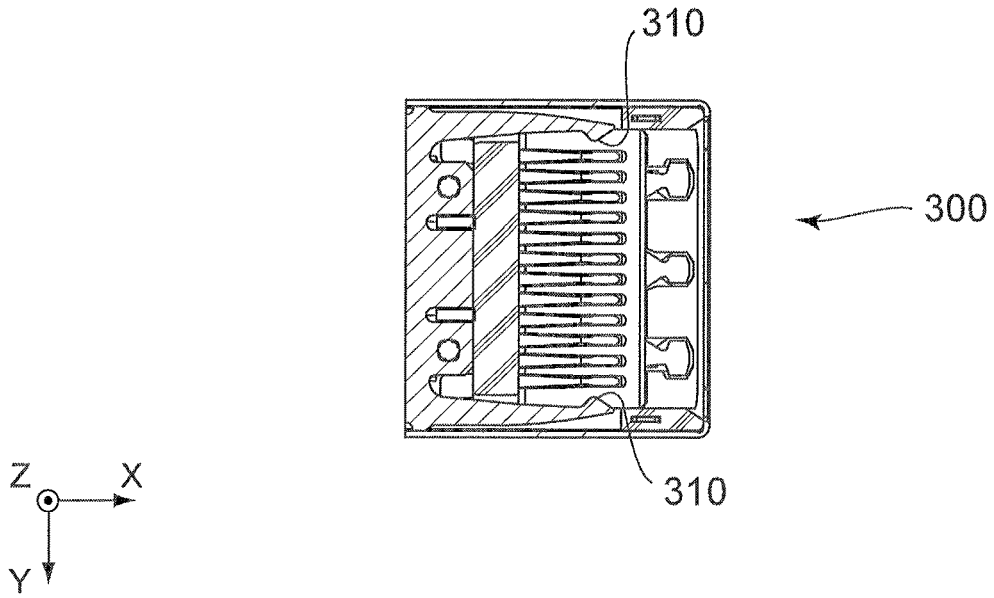
FIG. 13 is a cross-sectional view showing a mating connector.
Figure 14:
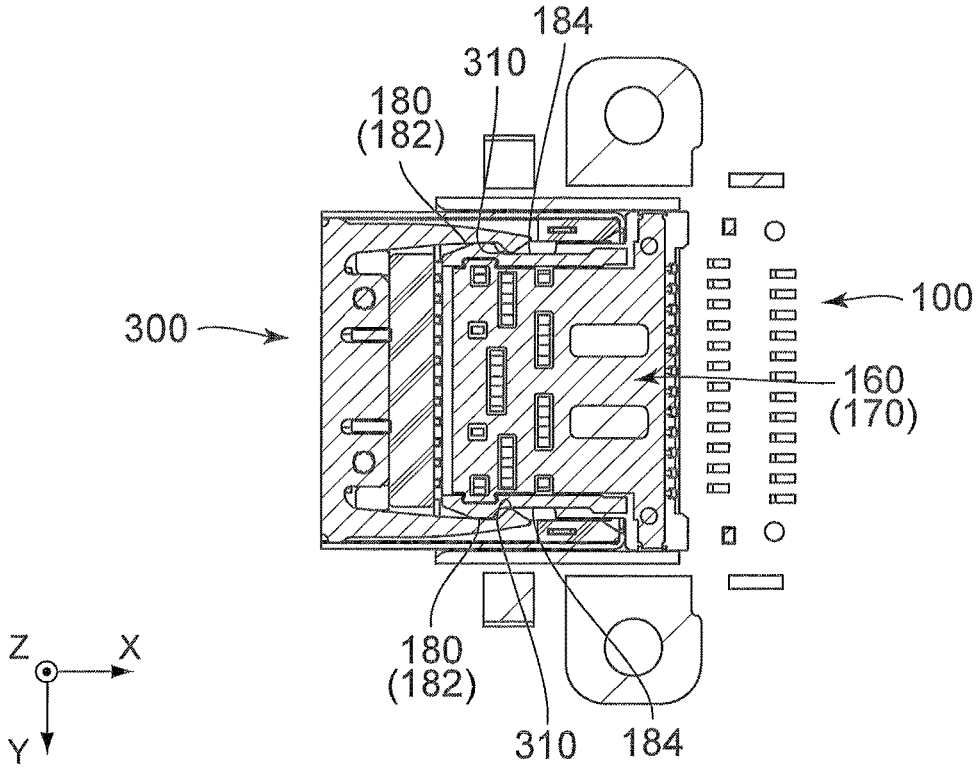
FIG. 14 is a cross-sectional view showing a connector assembly comprising the connector of FIG. 1 and the mating connector of FIG. 13. The connector is mated with the mating connector.

Referring to FIGS. 1, 13 and 14, a connector 100 according to a first embodiment of the present invention is mateable with a mating connector 300 along a mating direction. In the present embodiment, the mating direction is an X-direction. Additionally, in the present embodiment, the mating direction is a front-rear direction. As shown in FIG. 13, the mating connector 300 of the present embodiment has mating lock portions 310 each made of metal. Each of the mating lock portions 310 is a locking lug which protrudes inward in a pitch direction. In the present embodiment, the pitch direction is a Y-direction and is perpendicular to the mating direction.

Referring to FIGS. 1 to 6, the connector 100 of the present embodiment has a mating end at a front end thereof in the front-rear direction (mating direction). The connector 100 of the present embodiment comprises a structure 110 and a shell 115 which covers the structure 110. The shell 115 of the present embodiment is made of metal.

As understood from FIGS. 1 to 7, the structure 110 comprises a holding member 120, a plurality of terminals 140, 150 and a conductive member 160.

Figure 5:
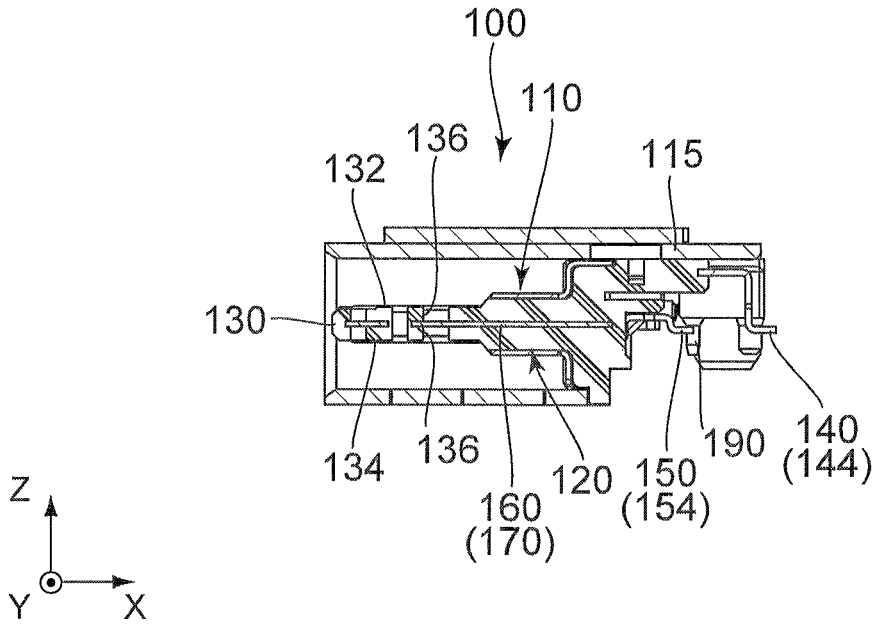
FIG. 5 is a cross-sectional view showing the connector of FIG. 2, taken along line B-B.
Figure 6:
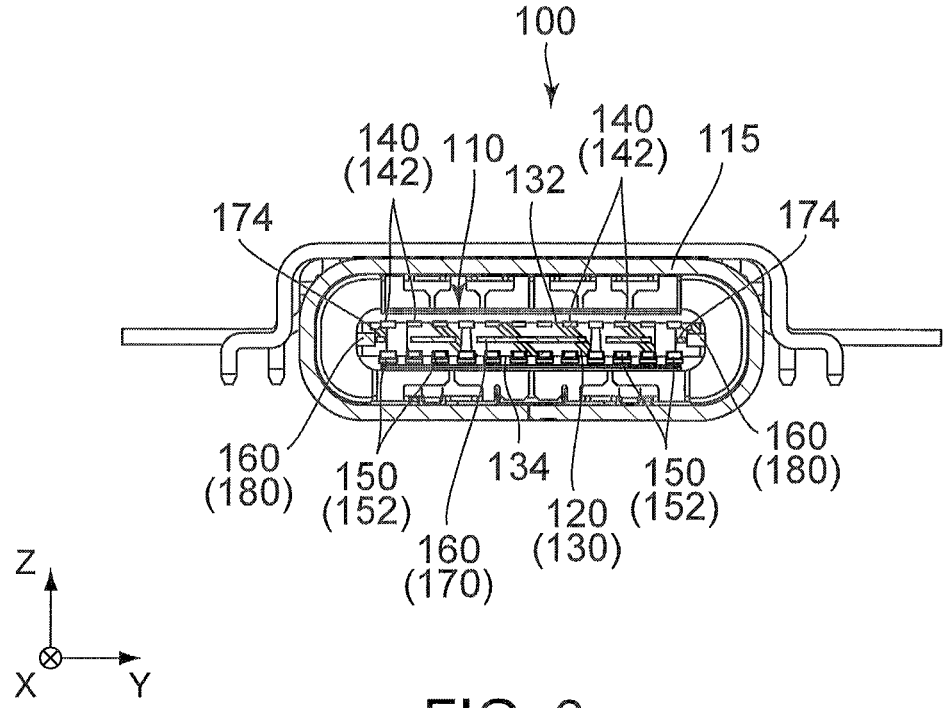
FIG. 6 is a cross-sectional view showing the connector of FIG. 3, taken along line C-C.

The holding member 120 is made of insulator. Specifically, the holding member 120 of the present embodiment is a molded product made of resin. The holding member 120 of the present embodiment has a tongue portion 130 which extends in both the mating direction and the pitch direction. As shown in FIGS. 5 and 6, the tongue portion 130 has two principal surfaces 132, 134 each facing in a perpendicular direction. In the present embodiment, the perpendicular direction is a Z-direction and is perpendicular to both the mating direction and the pitch direction. In the present embodiment, the perpendicular direction is an up-down direction. The tongue portion 130 is formed with holes 136 each extending in the perpendicular direction from the principal surface 132, 134. Explanation about the holes 136 is made later.

Each of the terminals 140, 150 is made of conductor. Specifically, each of the terminals 140, 150 is made of metal. As shown in FIGS. 2, 4, 6 and 7, each of the terminals 140, 150 is held by the holding member 120. Specifically, the terminals 140, 150 of the present embodiment are embedded into the holding member 120 via insert-molding when the holding member 120 is molded. Accordingly, each of the terminals 140, 150 is partially embedded in the holding member 120.

Each of the terminals 140 has a contact portion 142 and a fixed portion 144. Each of the terminals 150 has a contact portion 152 and a fixed portion 154.

As shown in FIG. 6, the contact portions 142, 152 are arranged in two rows along the pitch direction. Specifically, the contact portions 142 are arranged in one row along the pitch direction while the contact portions 152 are arranged in another row along the pitch direction. The row of the contact portions 142 and the row of the contact portions 152 are positioned away from each other in the perpendicular direction. The contact portions 142 are arranged on the principal surface 132 of the tongue portion 130. Each of the contact portions 142 is partially exposed outside the tongue portion 130 in the perpendicular direction. The contact portions 152 are arranged on the principal surface 134 of the tongue portion 130. Each of the contact portions 152 is partially exposed outside the tongue portion 130 in the perpendicular direction.

When the connector 100 is mounted on a circuit board (not shown), the fixed portions 144, 154 are connected and fixed by soldering or the like to wires or traces provided on the circuit board. As expected from FIGS. 4 and 5, the circuit board is arranged between opposite ends of the connector 100 in the perpendicular direction. Specifically, the circuit board is arranged in the vicinity of a middle of the opposite ends of the connector 100 in the perpendicular direction. In other words, the circuit board is arranged between an upper end and a lower end of the connector 100 in the up-down direction. Specifically, the circuit board is arranged in the vicinity of a middle of the connector 100 in the up-down direction.

The conductive member 160 is made of conductor. Specifically, the conductive member 160 is made of metal. As understood from FIGS. 4 to 7, the conductive member 160 is held by the holding member 120. Specifically, the conductive member 160 of the present embodiment is embedded into the holding member 120 via insert-molding when the holding member 120 is molded. Accordingly, the conductive member 160 is partially embedded in the holding member 120.

As shown in FIGS. 8 to 11, the conductive member 160 has a first portion 170 and two second portions 180, wherein the first portion 170 has a plate-like shape. In the present embodiment, each of the second portions 180 is distinct and separated from the first portion 170. As described later, each of the second portions 180 is assembled with the first portion 170. The first portion 170 is formed by punching out a single metal plate as a base member. Each of the second portions 180 is formed by punching out a blank from another metal plate, which has a thickness greater than a thickness of the metal plate of the base member of the first portion 170, followed by bending the blank. Accordingly, each of the second portions 180 is thicker than the first portion 170. In the perpendicular direction, each of the second portions 180, as a whole, has a size greater than a size of the first portion 170.

Figure 4:
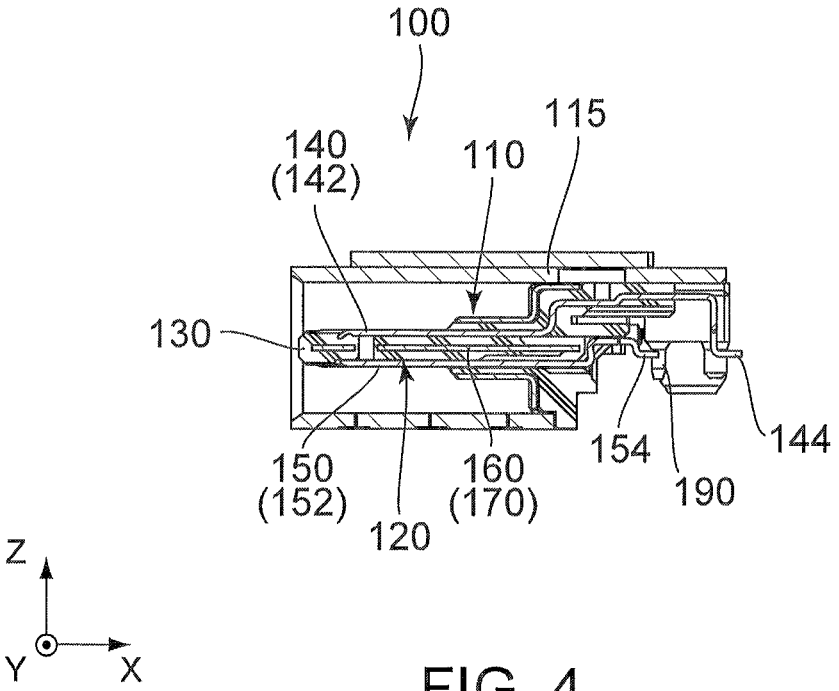
FIG. 4 is a cross-sectional view showing the connector of FIG. 2, taken along line A-A.

As understood from FIGS. 4 to 6, the first portion 170 is positioned between the contact portions 142, 152 of the two rows in the perpendicular direction. As understood from FIGS. 5 and 7, each of the holes 136, which are formed on the tongue portion 130, reaches the first portion 170 in the perpendicular direction. The first portion 170 forms a bottom of each of the holes 136. In the present embodiment, the first portion 170 forms the bottom of each of the holes 136 because the first portion 170 is sandwiched by two metal molds in the perpendicular direction upon the aforementioned insert-molding.

Figure 9:
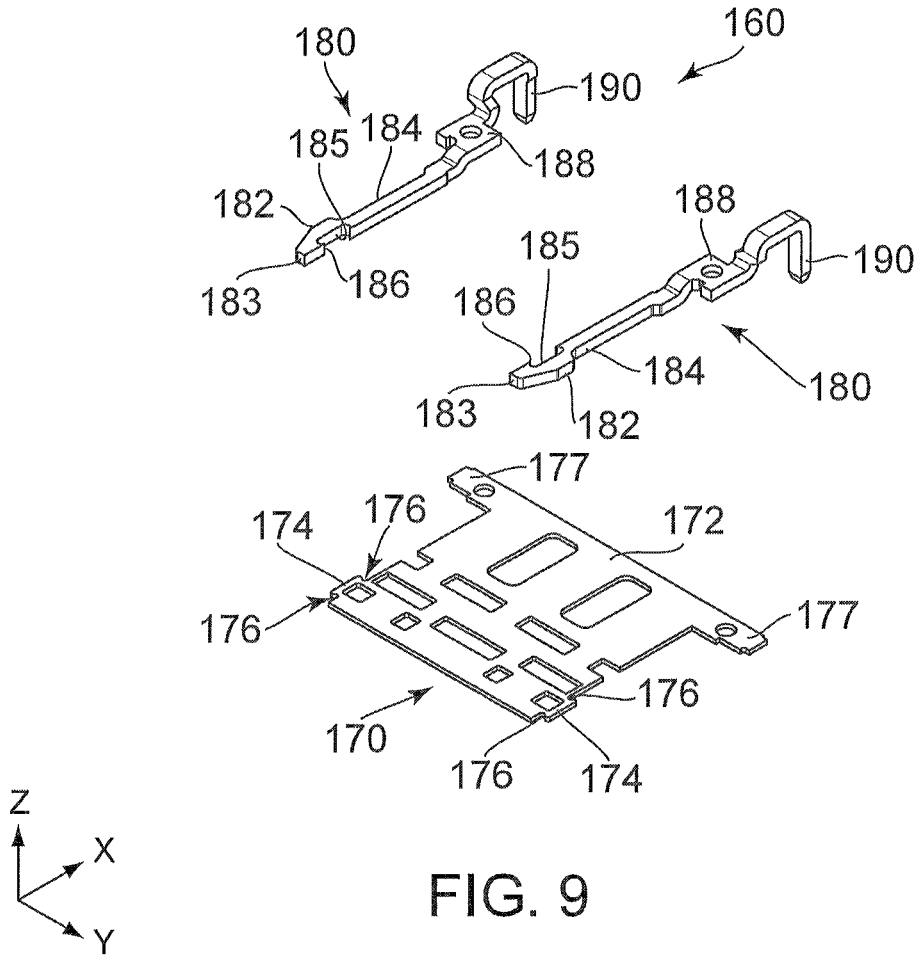
FIG. 9 is an exploded, perspective view showing the conductive member of FIG. 8.
Figure 10:
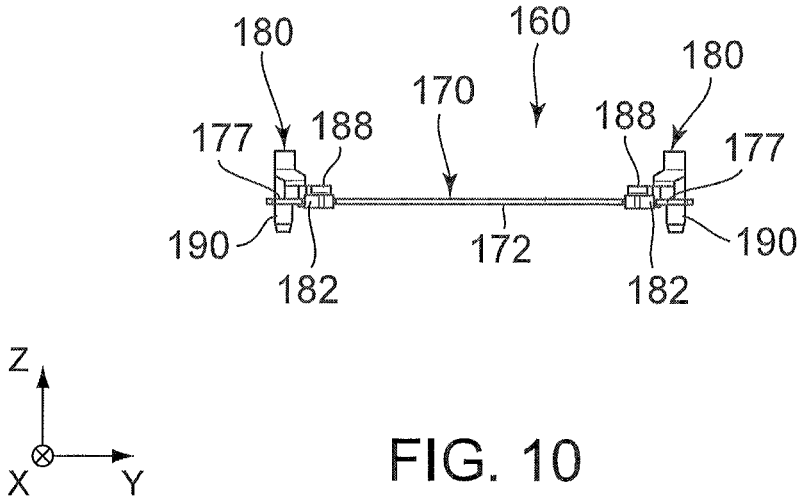
FIG. 10 is a front view showing the conductive member of FIG. 8.

As shown in FIG. 9, the first portion 170 has a main portion 172, two tabs 174 and two coupling tabs 177. Each of the tabs 174 protrudes outward in the pitch direction. In the front-rear direction (mating direction), each of the tabs 174 is closer to a front end of the main portion 172. In the front-rear direction (mating direction), each of the coupling tabs 177 is closer to a rear end of the main portion 172. Each of the tabs 174 has a male dovetail shape (inverted trapezoid-like shape). A boundary portion between each of the tabs 174 and the main portion 172 is formed with two recesses each of which is recessed along the mating direction. In the present embodiment, each of the recesses functions as a first engagement portion 176. In other words, the first portion 170 of the present embodiment has two pairs each consisting of two of the first engagement portions 176, and the pairs correspond to the tabs 174, respectively. Specifically, the two first engagement portions 176 of the pair, which corresponds to each of the tabs 174, are recessed so as to be close to each other in the mating direction. In other words, the pairs each consisting of the two first engagement portions 176 are arranged in the vicinities of opposite ends, respectively, of the first portion 170 of the present embodiment in the pitch direction. Each of the coupling tabs 177 protrudes outward in the pitch direction. In the present embodiment, the coupling tab 177 has a size greater than a size of the tab 174.

Figure 7:
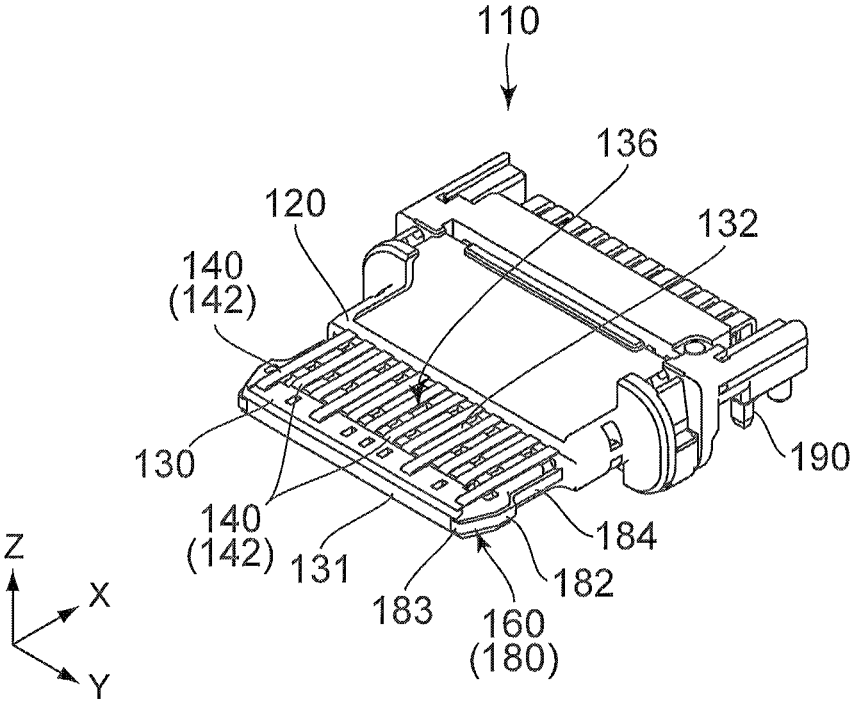
FIG. 7 is a perspective view showing a structure other than a shell, which is included in the connector of FIG. 1.
Figure 8:
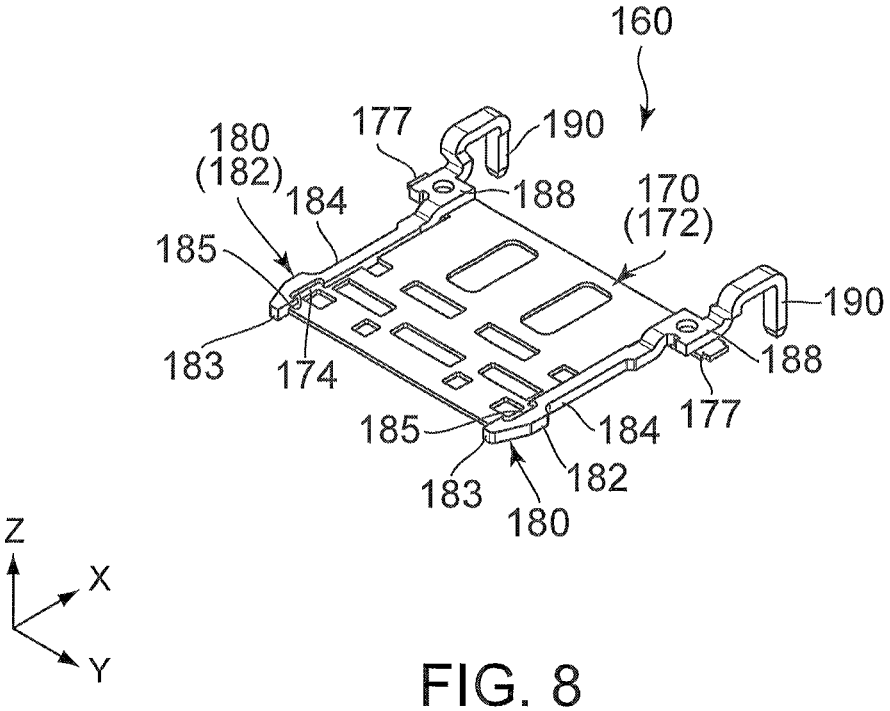
FIG. 8 is a perspective view showing a conductive member which is included in the connector of FIG. 1.

As understood from FIGS. 8 and 9, the second portions 180 are positioned at the opposite ends, respectively, of the first portion 170 in the pitch direction. As shown in FIG. 7, each of the second portions 180 is partially exposed outside the tongue portion 130 in both the mating direction and the pitch direction.

Specifically, as shown in FIG. 9, each of the second portions 180 has a lock portion 182, a straight portion 184, a coupling portion 188 and a fixed portion 190.

Figure 11:
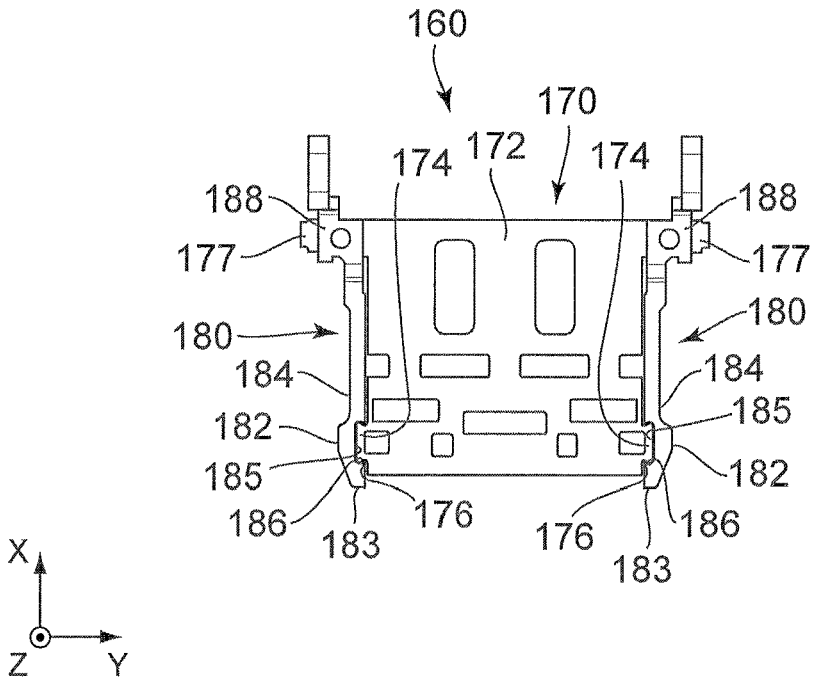
FIG. 11 is a top view showing the conductive member of FIG. 8.

As shown in FIGS. 8 and 11, the lock portion 182 extends outward in the pitch direction. As shown in FIG. 14, the lock portion 182 locks, together with the mating lock portion 310, a state where the connector 100 and the mating connector 300 are mated with each other.

As shown in FIG. 7, the lock portion 182 is exposed outside the tongue portion 130 in the pitch direction. An end 183 of the lock portion 182 is exposed at a front end 131 of the tongue portion 130. In other words, the end 183 of the lock portion 182 is visible when the connector 100 is viewed from its front. In addition, the lock portion 182 is partially visible even when the structure 110 is viewed along the perpendicular direction.

Figure 12:
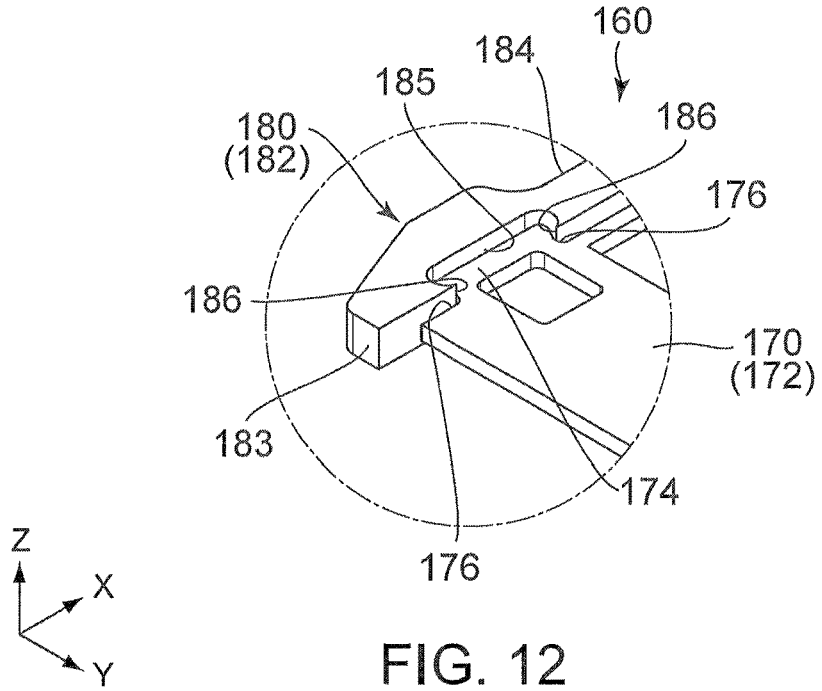
FIG. 12 is a perspective view showing a part of the conductive member of FIG. 8.

As understood from FIGS. 11 and 12, a receiving portion 185 is formed inward of the lock portion 182 in the pitch direction. The receiving portion 185 has a female dovetail shape. The receiving portion 185 is opened inward in the pitch direction, and is recessed outward in the pitch direction. Opposite edges of the opening of the receiving portion 185 function as second engagement portions 186, respectively. In other words, each of the second portions 180 is formed with the two second engagement portions 186. In the mating direction, the two second engagement portions 186 face each other and extend so as to be close to each other.

As shown in FIG. 11, the receiving portions 185 receive the tabs 174, respectively. Specifically, as best illustrated in FIG. 12, each of the tabs 174 is mated with the receiving portion 185 corresponding thereto in a dovetail manner. The second engagement portions 186 are engaged with the first engagement portions 176, respectively. In other words, each of the vicinities of opposite ends of the conductive member 160 in the pitch direction is provided with two engagement pairs each of which consists of the first engagement portion 176 and the second engagement portion 186.

Each of the second engagement portions 186 is received in the first engagement portion 176 corresponding thereto in the mating direction. Accordingly, in a state before the conductive member 160 is embedded into the holding member 120 (see FIG. 7), the first portion 170 is regulated in its movement in the pitch direction relative to each of the second portions 180. Especially, in the present embodiment, the two second engagement portions 186 of each of the receiving portions 185 are engaged with the two first engagement portions 176, respectively, of the corresponding pair of the tab 174 corresponding thereto. Thus, the first portion 170 is regulated in its movement also in the mating direction relative to each of the second portions 180.

As apparent from FIG. 12, in the perpendicular direction, the second engagement portion 186 has a size different from a size of the first engagement portion 176. In detail, in the perpendicular direction, the second engagement portion 186 has the size greater than the size of the first engagement portion 176. Accordingly, in the state before the conductive member 160 is embedded into the holding member 120 (see FIG. 7), the engagements of the first engagement portions 176 and the second engagement portions 186 can be maintained even if the first portion 170 is moved, to some extent, relative to each of the second portions 180 in the perpendicular direction. In other words, in the state before the conductive member 160 is embedded into the holding member 120, the first portion 170 is allowed to be moved relative to each of the second portions 180 in the perpendicular direction.

As understood from FIGS. 6 and 11, each of the first engagement portions 176 and the second engagement portions 186 is positioned outward of the contact portions 142, 152 of the two rows in the pitch direction. Accordingly, a size of each of the second engagement portions 186 in the perpendicular direction can be greater than a size of each of the first engagement portions 176 in the perpendicular direction without enlarging a size of the tongue portion 130 in the perpendicular direction and without excessively reducing a thickness of the first portion 170.

As shown in FIGS. 8 and 11, the straight portion 184 is positioned away from the end 183 of the lock portion 182 and extends from the lock portion 182 along the mating direction. As shown in FIG. 7, the straight portion 184 is exposed outside the tongue portion 130 in the pitch direction. In addition, the straight portion 184 is partially visible even when the structure 110 is viewed along the perpendicular direction.

As described above, in the present embodiment, each of the lock portion 182 and the straight portion 184 is partially visible when the structure 110 is viewed along the perpendicular direction. In other words, each of the second portions 180 is partially exposed outside the tongue portion 130 in the perpendicular direction. Each of the second portions 180 is exposed outside the tongue portion 130 in the perpendicular direction because each of the second portions 180 is sandwiched by the two metal molds in the perpendicular direction upon the aforementioned insert-molding.

The coupling portion 188 is positioned further away from the lock portion 182 than the straight portion 184. Specifically, the straight portion 184 is positioned between the coupling portion 188 and the lock portion 182. The coupling portion 188 is coupled with the coupling tab 177. As described above, the second portions 180 of the present embodiment are connected with the first portion 170 at positions, respectively, each of which is positioned away from each of the first engagement portions 176 and the second engagement portions 186 in the mating direction.

When the connector 100 is mounted on the circuit board (not shown), the fixed portion 190 is inserted into a hole (not shown), which is formed on the circuit board, to be fixed to the circuit board.

As described above, the connector 100 comprising the conductive member 160 is fabricated by using insert-molding. A method of fabricating the connector 100 is described below. The method of fabricating the connector 100 comprises; a step of preparing the conductive member 160, a step of positioning the first portion 170 and the second portions 180 by the conductive member 160 being set in the metal molds (not shown) so that the metal molds sandwich each of the first portion 170 and the second portions 180 therebetween, and a step of pouring or filling a resin in the metal molds to mold the resin so that the holding member 120 is formed while the holding member 120 holds the conductive member 160. The conductive member 160 has the first portion 170 and the two second portions 180, wherein the first portion 170 has the plate-like shape. The first portion 170 intersects with the perpendicular direction. The first portion 170 has at least two of the first engagement portions 176. The second portions 180 are positioned at the opposite ends, respectively, of the first portion 170 in the pitch direction perpendicular to the perpendicular direction. Each of the second portions 180 has the second engagement portion 186. In the perpendicular direction, the second engagement portion 186 has the size different from the size of the first engagement portion 176. One of the first engagement portion 176 and the second engagement portion 186 is recessed in the mating direction. A remaining one of the first engagement portion 176 and the second engagement portion 186 protrudes in the mating direction and is received in the one of the first engagement portion 176 and the second engagement portion 186. Accordingly, the second engagement portions 186 are engaged with the first engagement portions 176, respectively, so as to regulate a movement of the first portion 170 relative to each of the second portions 180 in the pitch direction while allowing a movement of the first portion 170 relative to each of the second portions 180 in the perpendicular direction.

Upon the aforementioned insert-molding, each of the first portion 170 and the second portions 180 is sandwiched by the metal molds (not shown) to be positioned in the perpendicular direction. Meanwhile, the first portion 170 is movable, to some extent, relative to each of the second portions 180 in the perpendicular direction. Accordingly, even if the first portion 170 has variations in size, or even if each of the second portions 180 has variations in size, or further, even if there are manufacturing variations in the assembly of the first portion 170 and the second portions 180, the holding member 120 can be molded after the first portion 170 is arranged at an appropriate position in the metal molds. Thus, the first portion 170 can be arranged in a balanced manner relative to the contact portions 142, 152 of the two rows.

In the present embodiment, each of the vicinities of the opposite ends of the conductive member 160 in the pitch direction is provided with the two engagement pairs each of which consists of the first engagement portion 176 and the second engagement portion 186. The present invention is not limited thereto. The number of each of the first engagement portions 176 and the second engagement portions 186 is not limited thereto, provided that each of the opposite ends of the conductive member 160 in the pitch direction is provided with at least one pair consisting of the first engagement portion 176 and the second engagement portion 186.

Figure 15:
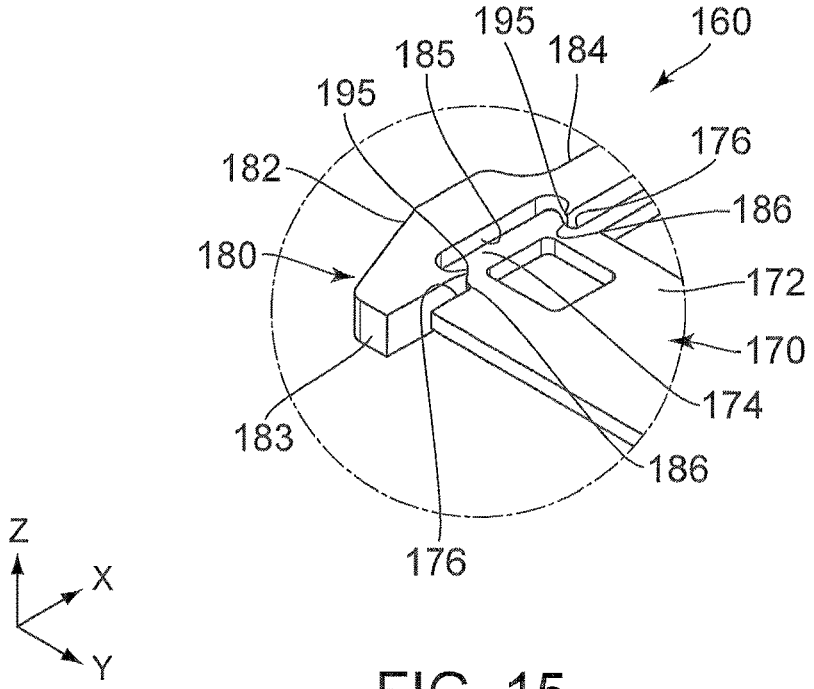
FIG. 15 is a perspective view showing a modification of the conductive member of FIG. 12.
Figure 16:
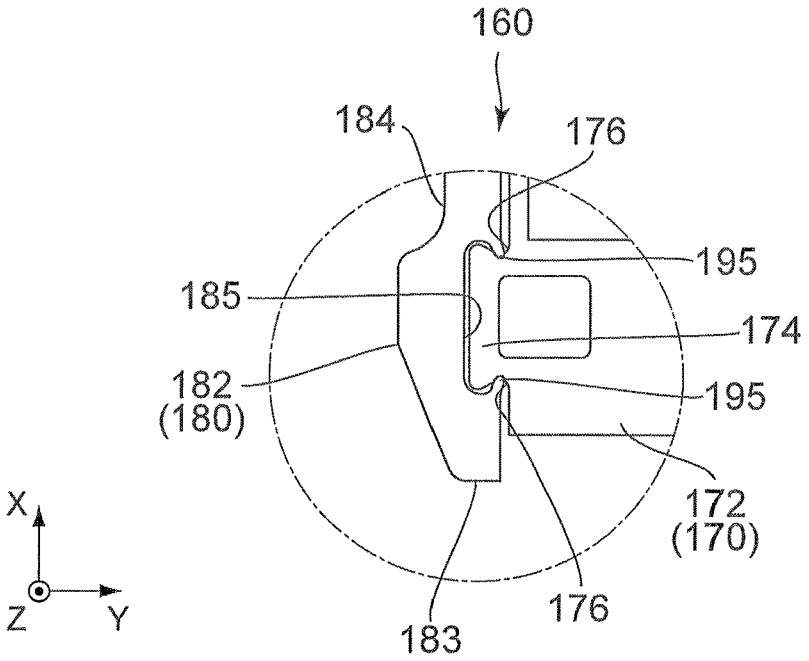
FIG. 16 is a top view showing a modification of the conductive member of FIG. 15.
Figure 17:
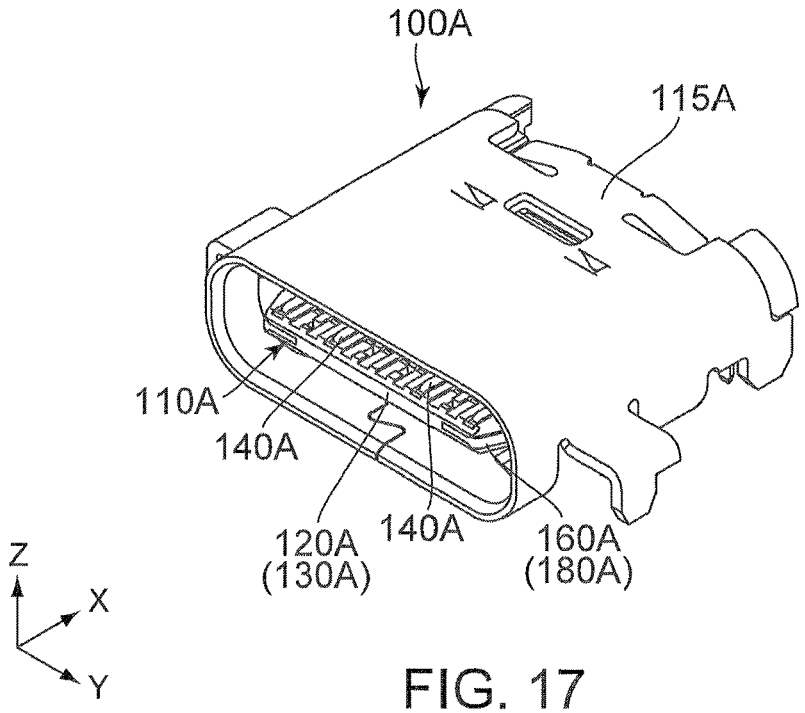
FIG. 17 is a perspective view showing a connector according to a second embodiment of the present invention.
Figure 18:
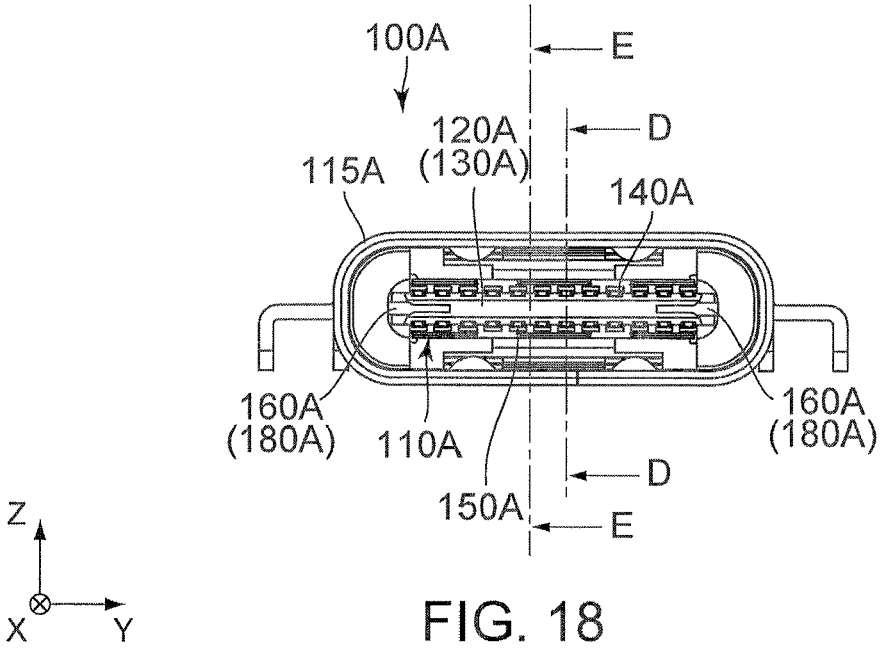
FIG. 18 is a front view showing the connector of FIG. 17.
Figure 19:
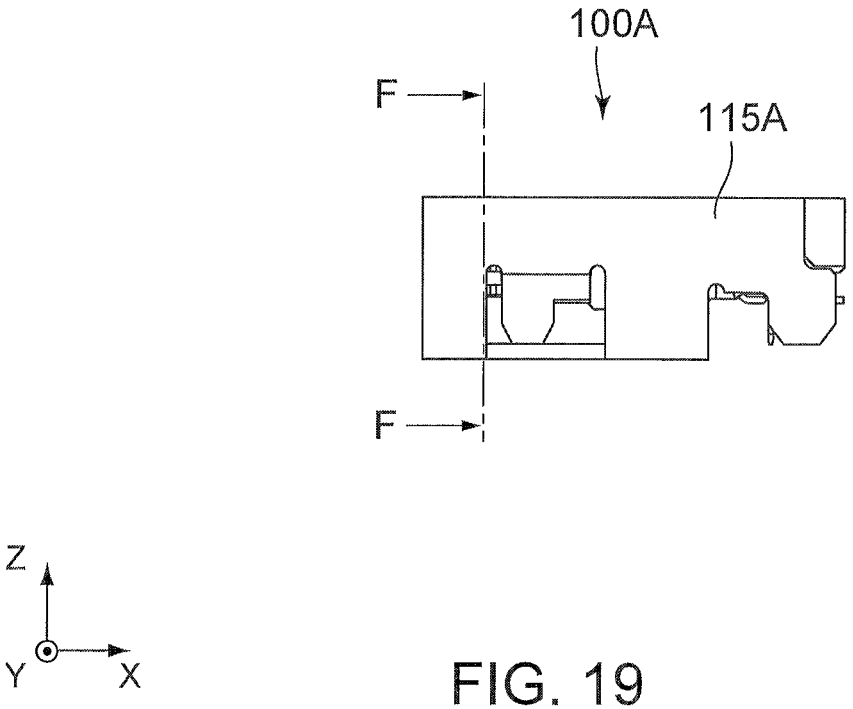
FIG. 19 is a side view showing the connector of FIG. 17.

In addition, the connector 100 according to the present embodiment can be modified as described below. Referring to FIGS. 15 and 16, a modified portion 195 may be formed by mating each of the tabs 174 with the receiving portion 185 corresponding thereto, followed by pressing and deforming each of opposite ends, in the perpendicular direction, of each of the second engagement portions 186. As shown in FIG. 15, each of the modified portions 195 has a reduced size in the perpendicular direction, so that, even if each of the second portions 180 has the modified portions 195, the conductive member 160 has a clearance which allows the first portion 170 to be moved in the perpendicular direction relative to each of the second portions 180. As understood from FIG. 16, each of the modified portions 195 overlaps with the first portion 170 when projected on a plane perpendicular to the perpendicular direction. Accordingly, each of the tabs 174 is prevented from being removed from the receiving portion 185 corresponding thereto even in a state before the insert-molding. The modified portion 195 is formed on each of the opposite ends, in the perpendicular direction, of each of the second engagement portions 186 (namely, each of the second engagement portions 186 is formed with the two modified portions 195). The modified portion 195 may however be formed on only one end, in the perpendicular direction, of each of the second engagement portions 186. As another modification, for example, the tab 174 may be modified in size or shape and be lightly press-fit into the receiving portion 185. Also in this case, when the conductive member 160 is set in the metal molds (not shown) so that each of the first portion 170 and the second portions 180 is sandwiched by the metal molds, each of the tabs 174 is, to some extent, movable in the receiving portion 185 corresponding thereto. Accordingly, each of the first portion 170 and the second portions 180 can be positioned at an appropriate position. In addition, the tab 174 may be lightly swaged so as to eliminate a clearance relative to the receiving portion 185 by squeezing the tab 174 in the perpendicular direction (Z-direction) to outwardly enlarge an outline of the tab 174.

Second Embodiment

Referring to FIGS. 17 to 22, a connector 100A according to a second embodiment of the present invention is a modification of the connector 100 of the first embodiment shown in each of FIGS. 1 to 6. Similar to the connector 100, the connector 100A is mateable with the mating connector 300 shown in each of FIGS. 13 and 14 along a mating direction. In the present embodiment, the mating direction is the X-direction. In the present embodiment, the mating direction is the front-rear direction. As described above, the mating connector 300 of FIG. 13 has the mating lock portions 310 each made of metal, and each of the mating lock portions 310 is the locking lug which protrudes inward in a pitch direction. In the present embodiment, the pitch direction is the Y-direction and is perpendicular to the mating direction.

Referring to FIGS. 17 to 22, the connector 100A of the present embodiment has a mating end at a front end thereof in the front-rear direction (mating direction). The connector 100A of the present embodiment comprises a structure 110A and a shell 115A which covers the structure 110A. The shell 115A of the present embodiment is made of metal.

As understood from FIGS. 17 to 23, the structure 110A comprises a holding member 120A, a plurality of terminals 140A, 150A and a conductive member 160A.

Figure 21:
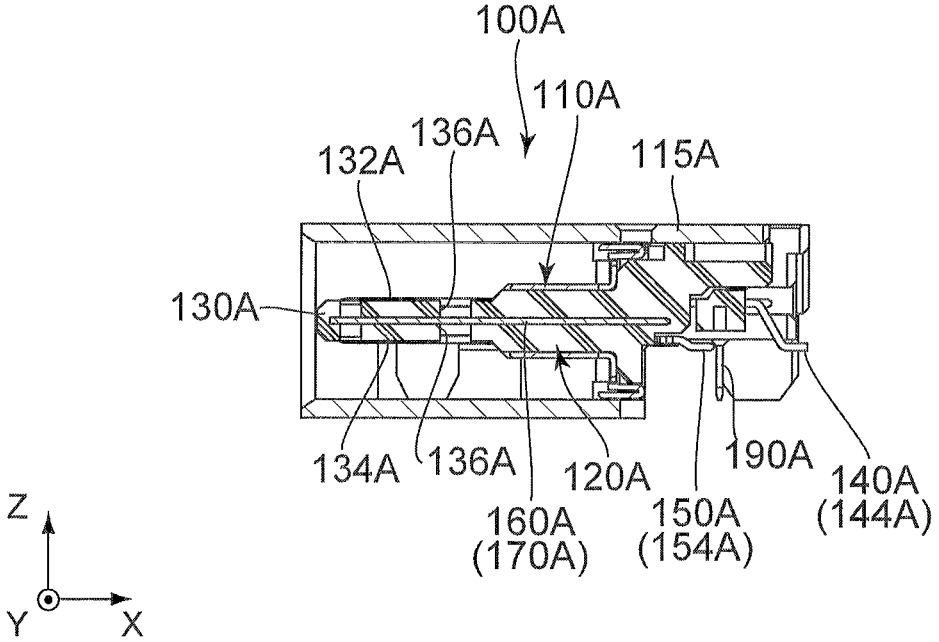
FIG. 21 is a cross-sectional view showing the connector of FIG. 18, taken along line E-E.
Figure 22:
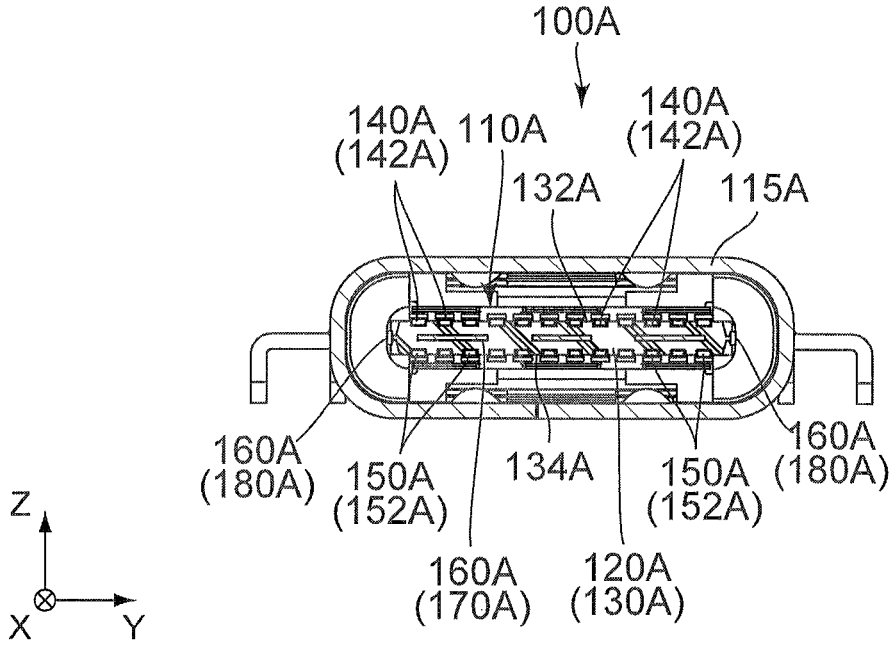
FIG. 22 is a cross-sectional view showing the connector of FIG. 19, taken along line F-F.

The holding member 120A is made of insulator. Specifically, the holding member 120A of the present embodiment is a molded product made of resin. The holding member 120A of the present embodiment has a tongue portion 130A which extends in both the mating direction and the pitch direction. As shown in FIGS. 21 and 22, the tongue portion 130A has two principal surfaces 132A, 134A each facing in a perpendicular direction. In the present embodiment, the perpendicular direction is the Z-direction and is perpendicular to both the mating direction and the pitch direction. In the present embodiment, the perpendicular direction is the up-down direction. The tongue portion 130A is formed with holes 136A each extending in the perpendicular direction from the principal surface 132A, 134A. Explanation about the hole 136A is made later.

Each of the terminals 140A, 150A is made of conductor. Specifically, each of the terminals 140A, 150A is made of metal. As shown in FIGS. 18, 20, 22 and 23, the terminals 140A, 150A are held by the holding member 120A. Specifically, each of the terminals 140A, 150A of the present embodiment is inserted forward from a rear end of the holding member 120A to be press-fit into the holding member 120A.

Each of the terminals 140A has a contact portion 142A and a fixed portion 144A. Each of the terminals 150A has a contact portion 152A and a fixed portion 154A.

As shown in FIG. 22, the contact portions 142A, 152A are arranged in two rows along the pitch direction. Specifically, the contact portions 142A are arranged in one row in the pitch direction while the contact portions 152A are arranged in another row in the pitch direction. The row of the contact portions 142A and the row of the contact portions 152A are positioned away from each other in the perpendicular direction. The contact portions 142A are arranged on the principal surface 132A of the tongue portion 130A. Each of the contact portions 142A is partially exposed outside the tongue portion 130A in the perpendicular direction. The contact portions 152A are arranged on the principal surface 134A of the tongue portion 130A. Each of the contact portions 152A is partially exposed outside the tongue portion 130A in the perpendicular direction.

When the connector 100A is mounted on a circuit board (not shown), the fixed portions 144A, 154A are connected and fixed by soldering or the like to wires or traces provided on the circuit board. As expected from FIGS. 20 and 21, the circuit board is arranged between opposite ends of the connector 100A in the perpendicular direction. Specifically, the circuit board is arranged in the vicinity of a middle of the opposite ends of the connector 100A in the perpendicular direction.

The conductive member 160A is made of conductor. Specifically, the conductive member 160A is made of metal. As understood from FIGS. 20 to 23, the conductive member 160A is held by the holding member 120A. Specifically, the conductive member 160A of the present embodiment is embedded into the holding member 120A via insert-molding when the holding member 120A is molded. Accordingly, the conductive member 160A is partially embedded in the holding member 120A.

Figure 24:
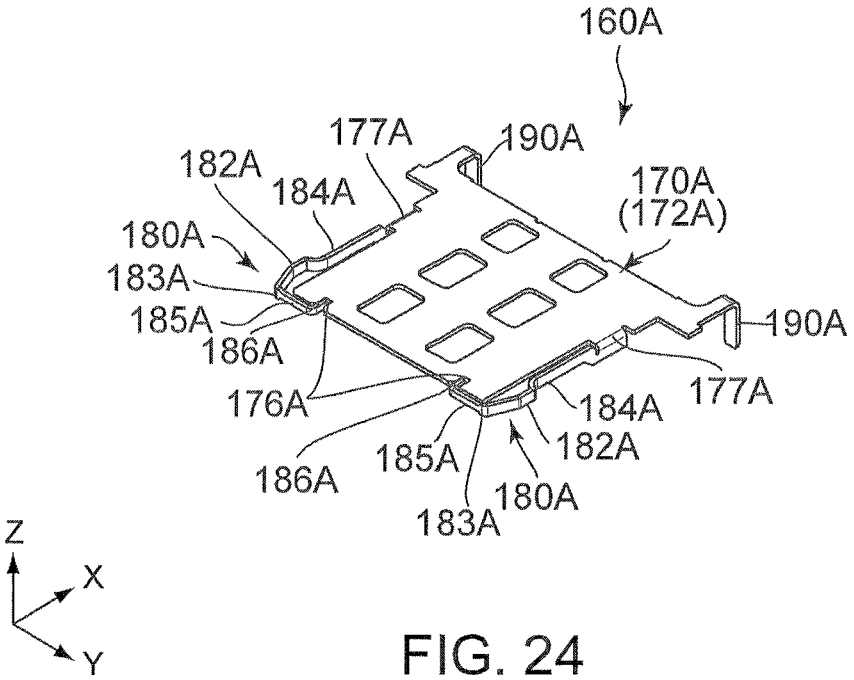
FIG. 24 is a perspective view showing a conductive member which is included in the connector of FIG. 17.
Figure 25:
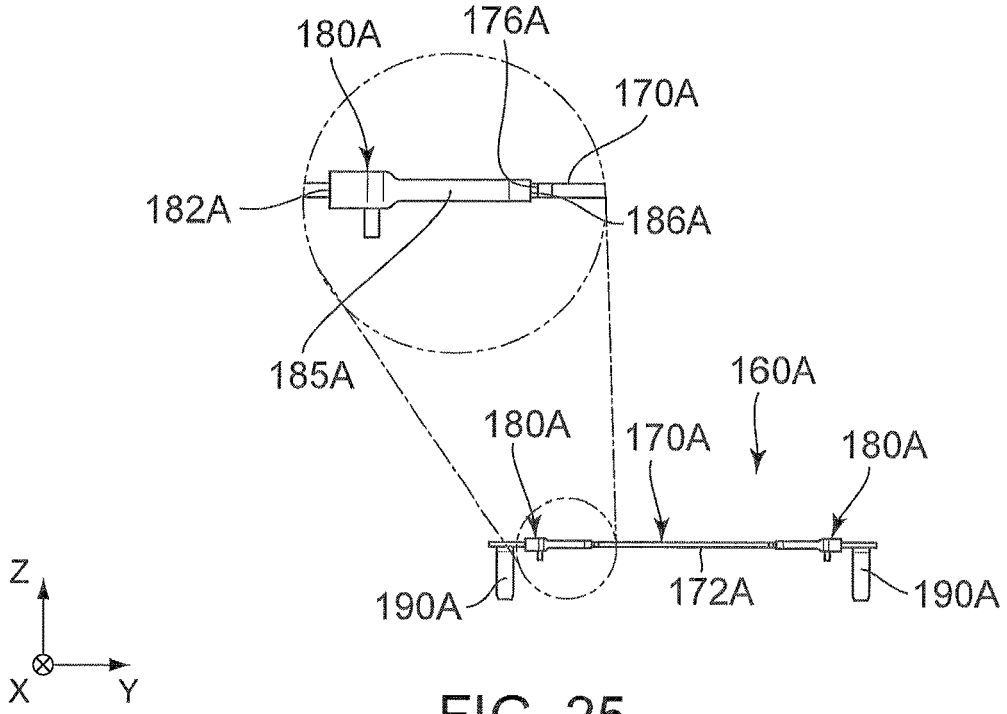
FIG. 25 is a front view showing the conductive member of FIG. 24. In the figure, a part of the conductive member is illustrated enlarged.
Figure 26:
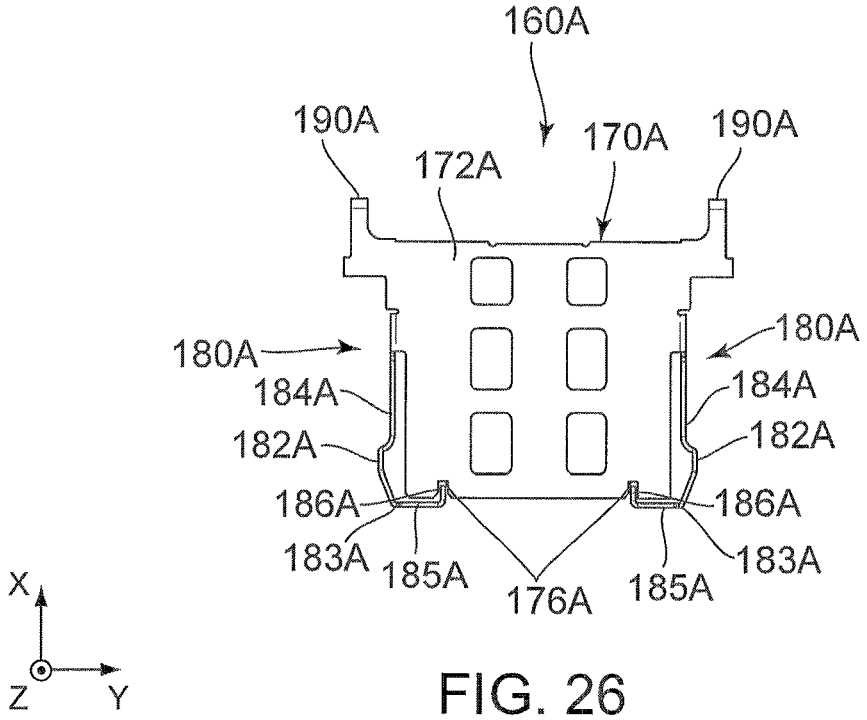
FIG. 26 is a top view showing the conductive member of FIG. 24.

As shown in FIGS. 24 to 27, the conductive member 160A has a first portion 170A and two second portions 180A, wherein the first portion 170A has a plate-like shape. In the present embodiment, the first portion 170A and each of the second portions 180A are continuous with each other to form a single component. Referring to FIGS. 26 and 28, the conductive member 160A is formed by punching a blank 160B out from a single metal plate, which has a constant thickness, followed by bending the blank 160B. Explanation about the blank 160B is made later.

Figure 20:
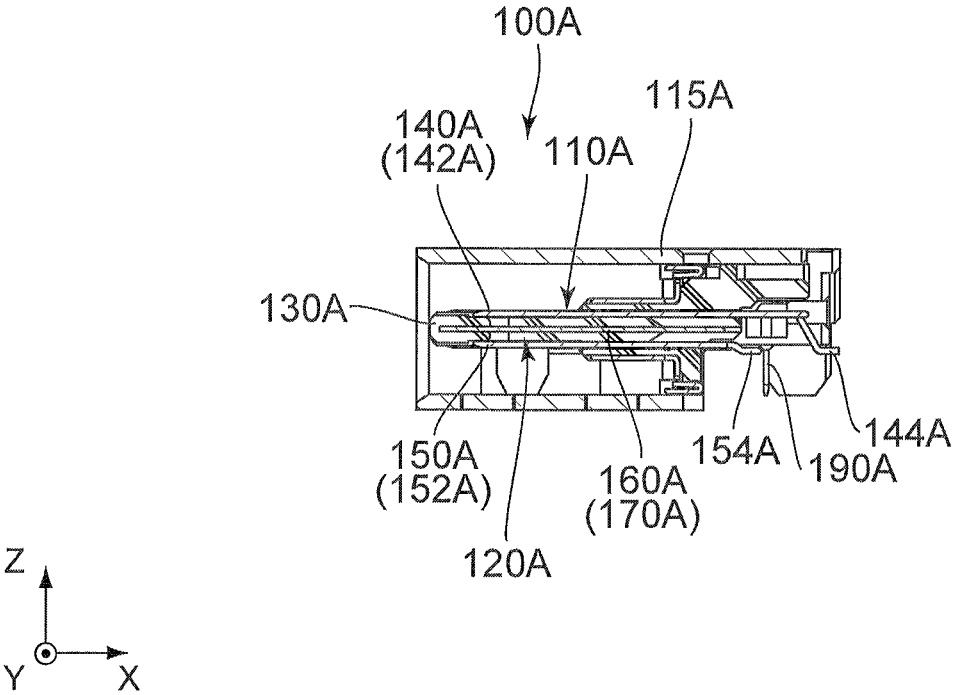
FIG. 20 is a cross-sectional view showing the connector of FIG. 18, taken along line D-D.

As understood from FIGS. 20 to 22, the first portion 170A is positioned between the contact portions 142A, 152A of the two rows in the perpendicular direction. As understood from FIGS. 21 and 23, each of the holes 136A, which are formed on the tongue portion 130A, reaches the first portion 170A in the perpendicular direction. The first portion 170A forms a bottom of each of the holes 136A. In the present embodiment, the first portion 170A forms the bottom of each of the holes 136A because the first portion 170A is sandwiched by two metal molds in the perpendicular direction upon the aforementioned insert-molding.

As shown in FIG. 24, the first portion 170A has a main portion 172A and two fixed portions 190A. Each of the fixed portions 190A is positioned at a rear end of the main portion 172A and extends in the perpendicular direction. When the connector 100A is mounted on the circuit board (not shown), the fixed portions 190A are inserted into holes (not shown), respectively, which are formed on the circuit board, to be fixed to the circuit board. A front end of the main portion 172A is formed with first engagement portions 176A. Each of the first engagement portions 176A is recessed rearward.

Figure 23:
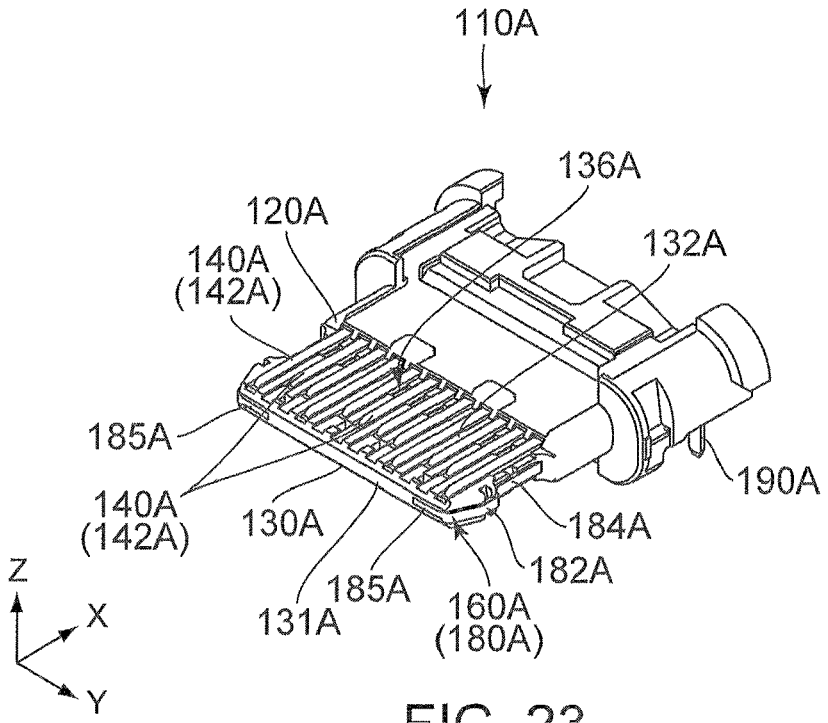
FIG. 23 is a perspective view showing a structure other than a shell, which is included in the connector of FIG. 17.

The main portion 172A has bent portions 177A at opposite ends thereof in the pitch direction. The second portions 180A extend from the bent portions 177A, respectively, in the perpendicular direction. Specifically, each of the second portions 180A is connected with the main portion 172A of the first portion 170A through the bent portion 177A corresponding thereto. As shown in FIG. 23, each of the second portions 180A is partially exposed outside the tongue portion 130A in both the mating direction and the pitch direction.

Specifically, as shown in FIGS. 24 and 26, each of the second portions 180A has a lock portion 182A, a straight portion 184A, a support portion 185A and a second engagement portion 186A.

The lock portion 182A extends outward in the pitch direction. Similar to the connector 100 of the first embodiment shown in FIG. 14, the lock portion 182A of FIG. 24 locks, together with the mating lock portion 310, a state where the connector 100A and the mating connector 300 are mated with each other.

As shown in FIG. 23, the lock portion 182A is exposed outside the tongue portion 130A in the pitch direction. The lock portion 182A is partially visible even when the structure 110A is viewed along the perpendicular direction.

As shown in FIGS. 24 and 26, the support portion 185A extends inward in the pitch direction from an end (front end) 183A of the lock portion 182A. As shown in FIG. 23, the support portion 185A is exposed at an end 131A of the tongue portion 130A. In other words, the support portion 185A is, at least in part, visible when the connector 100A is viewed from its front.

Figure 27:
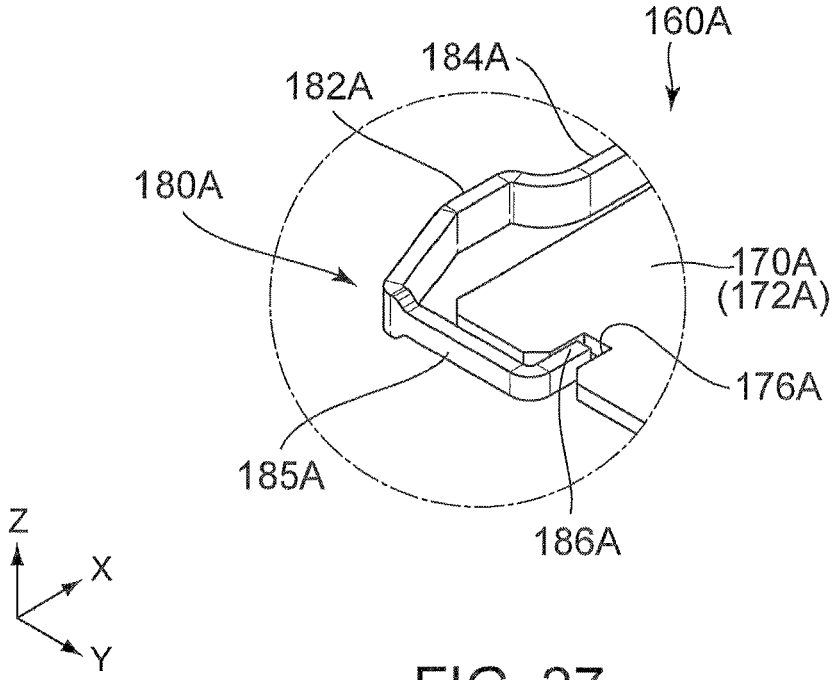
FIG. 27 is a perspective view showing a part of the conductive member of FIG. 24.
Figure 28:
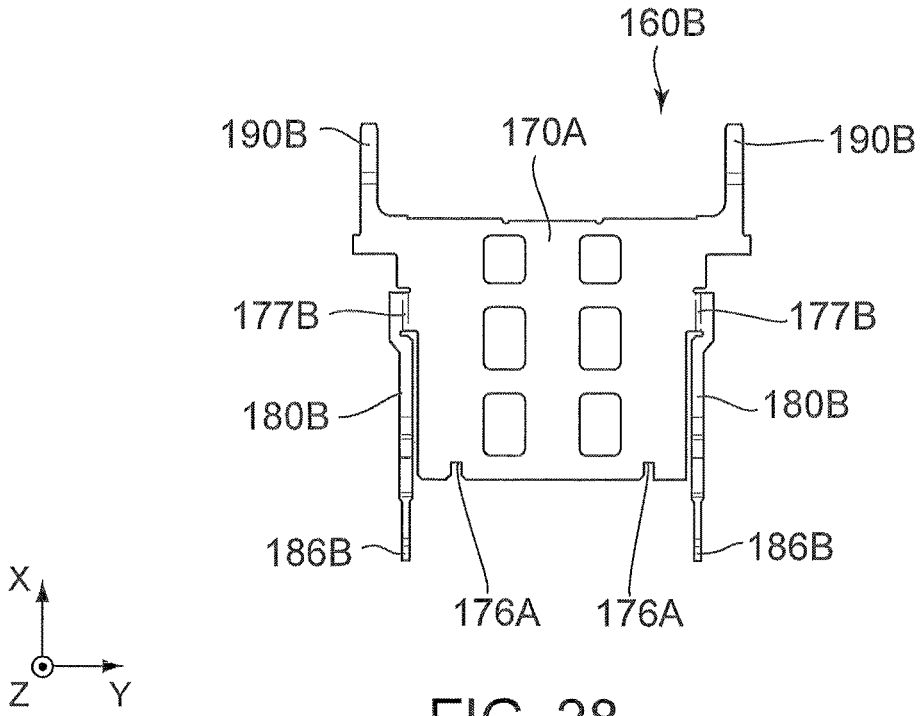
FIG. 28 is a top view showing a blank for the conductive member of FIG. 24.
Figure 29:
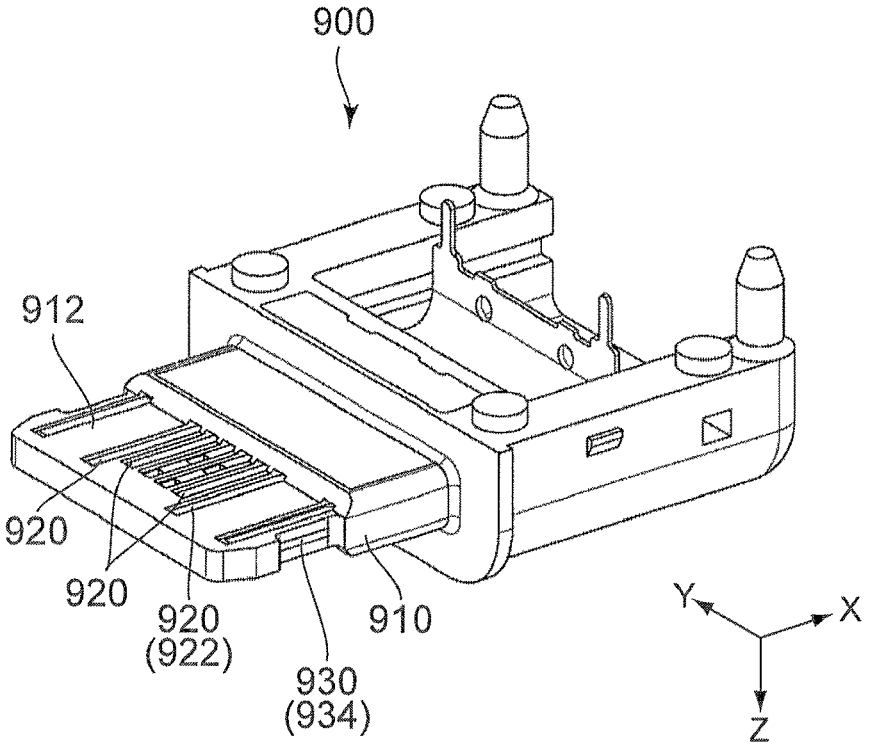
FIG. 29 is a perspective view showing a connector of Patent Document 1.
Figure 30:
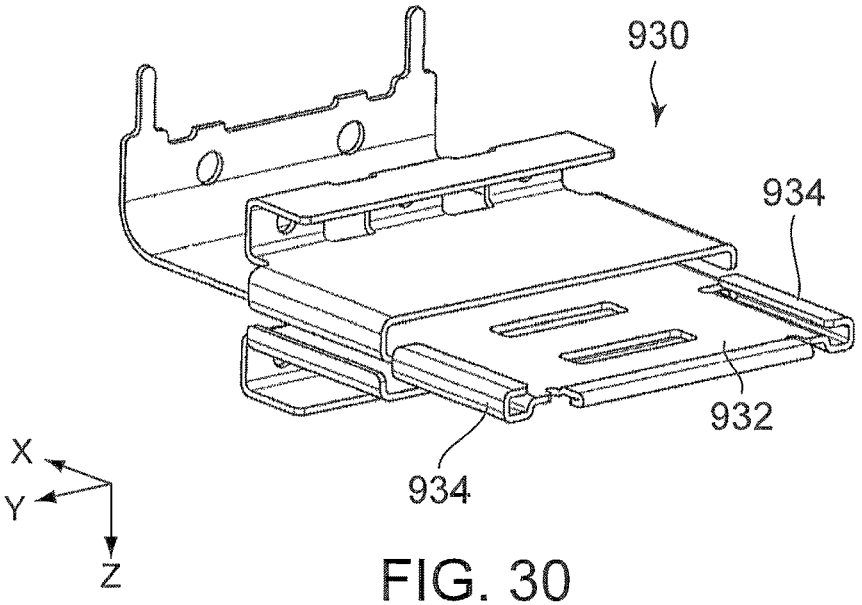
FIG. 30 is a perspective view showing a conductive member which is included in the connector of FIG. 29.
Figure 31:
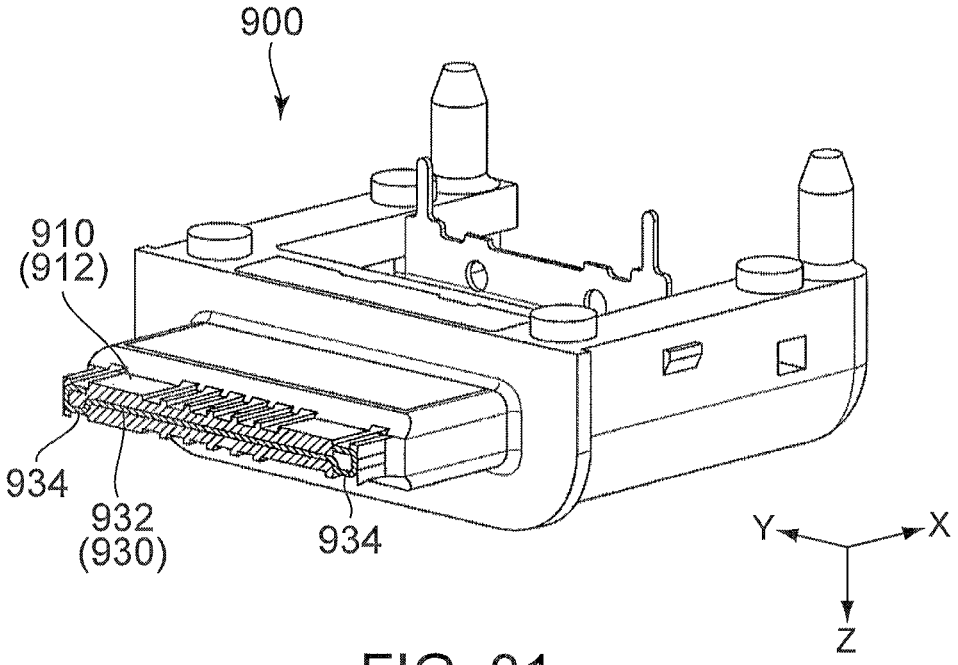
FIG. 31 is a perspective, cross-sectional view showing the connector of FIG. 29.

As shown in FIGS. 26 and 27, the second engagement portion 186A extends from an end (innermost end in the pitch direction) of the support portion 185A along the mating direction. In detail, the second engagement portion 186A extends rearward. The second engagement portions 186A are engaged with the first engagement portions 176A, respectively. As best illustrated in FIG. 27, each of the second engagement portions 186A is received in the first engagement portion 176A corresponding thereto. In the present embodiment, each of the second portions 180A has the single second engagement portion 186A. Specifically, the conductive member 160A of the present embodiment has two pairs each of which consists of the first engagement portion 176A and the second engagement portion 186A.

Each of the second engagement portions 186A is received in the first engagement portion 176A corresponding thereto in the mating direction. Accordingly, in a state before the conductive member 160A is embedded into the holding member 120A (see FIG. 23), the first portion 170A is regulated in its movement relative to each of the second portions 180A in the pitch direction.

As apparent from FIG. 25, in the perpendicular direction, the second engagement portion 186A has a size different from a size of the first engagement portion 176A. In detail, in the perpendicular direction, the second engagement portion 186A has the size greater than the size of the first engagement portion 176A. Accordingly, in the state before the conductive member 160A is embedded into the holding member 120A (see FIG. 23), the engagements of the first engagement portions 176A and the second engagement portions 186A can be maintained even if the first portion 170A is moved, to some extent, relative to each of the second portions 180A in the perpendicular direction. In other words, in the state before the conductive member 160A is embedded into the holding member 120A, the first portion 170A is allowed to be moved relative to each of the second portions 180A in the perpendicular direction.

As shown in FIGS. 24 and 26, the straight portion 184A is positioned away from the end 183A of the lock portion 182A and extends from the lock portion 182A along the mating direction. Specifically, the straight portion 184A extends rearward from the lock portion 182A. As shown in FIG. 23, the straight portion 184A is exposed outside the tongue portion 130A in the pitch direction. The straight portion 184A is partially visible even when the structure 110A is viewed along the perpendicular direction.

As described above, in the present embodiment, each of the lock portion 182A and the straight portion 184A is partially visible when the structure 110A is viewed along the perpendicular direction. In other words, the second portion 180A is partially exposed outside the tongue portion 130A in the perpendicular direction. The second portion 180A is exposed outside the tongue portion 130A in the perpendicular direction because the second portion 180A is sandwiched by the two metal molds in the perpendicular direction upon the aforementioned insert-molding.

As shown in FIG. 24, each of the bent portions 177A couples a rear end of the straight portion 184A corresponding thereto with the first portion 170A. Specifically, the first portion 170A and the second portions 180A of the present embodiment are continuous with each other at positions, respectively, each of which is positioned away from each of the first engagement portions 176A and the second engagement portions 186A in the mating direction.

Referring to FIGS. 26 and 28, the conductive member 160A is formed by bending the blank 160B as described above. As shown in FIG. 28, the blank 160B has a constant thickness. The blank 160B has the first portion 170A, two side portions 180B and two rear end portions 190B. Each of the side portions 180B has a width greater than its thickness. In other words, a size of the side portion 180B in the pitch direction is greater than a size of the side portion 180B in the perpendicular direction. Accordingly, when the blank 160B is bent at portions 177B so that each of the side portions 180B is perpendicular to the pitch direction, each of the side portions 180B thus bent has a size in the perpendicular direction greater than its size in the pitch direction. Referring to FIGS. 26 and 28, the second portion 180A is formed from the above-described side portion 180B, so that, in the perpendicular direction, the second portion 180A has a size greater than a size of the first portion 170A. An end 186B of the side portion 180B is bent so as to extend rearward, so that the end 186B becomes the second engagement portion 186A (See FIG. 26). The rear end portion 190B is bent so as to extend in the perpendicular direction, so that the rear end portion 190B becomes the fixed portion 190A.

As described above, the connector 100A comprising the conductive member 160A is fabricated by using insert-molding. A method of fabricating the connector 100A is described below. The method of fabricating the connector 100A comprises; a step of preparing the conductive member 160A, a step of positioning the first portion 170A and the second portions 180A by the conductive member 160A being set in the metal molds (not shown) so that the metal molds sandwich each of the first portion 170A and the second portions 180A therebetween, and a step of pouring or filling a resin in the metal molds to mold the resin so that the holding member 120A is formed while the holding member 120A holds the conductive member 160A. The conductive member 160A has the first portion 170A and the two second portions 180A, wherein the first portion 170A has the plate-like shape. The first portion 170A intersects with the perpendicular direction. The second portions 180A are positioned at the opposite ends, respectively, of the first portion 170A in the pitch direction. The first portion 170A has at least two of the first engagement portions 176A. Each of the second portions 180A has the second engagement portion 186A. In the perpendicular direction, the second engagement portion 186A has the size different from the size of the first engagement portion 176A. One of the first engagement portion 176A and the second engagement portion 186A is recessed in the mating direction, and a remaining one of the first engagement portion 176A and the second engagement portion 186A protrudes in the mating direction and is received in the one of the first engagement portion 176A and the second engagement portion 186A. Accordingly, the second engagement portions 186A are engaged with the first engagement portions 176A, respectively, so as to regulate a movement of the first portion 170A relative to each of the second portions 180A in the pitch direction while allowing a movement of the first portion 170A relative to each of the second portions 180A in the perpendicular direction.

Upon the aforementioned insert-molding, each of the first portion 170A and the second portions 180A is sandwiched by the metal molds (not shown) to be positioned in the perpendicular direction. Meanwhile, the first portion 170A is movable, to some extent, relative to each of the second portions 180A in the perpendicular direction. Accordingly, even if the first portion 170A has variations in size, or even if the second portion 180A has variations in size, or further, even if there are manufacturing variations in the assembly of the first portion 170A and the second portions 180A, the holding member 120A can be molded after the first portion 170A is arranged at an appropriate position in the metal molds. Thus, the first portion 170A can be arranged in a balanced manner relative to the contact portions 142A, 152A of the two rows.

In the aforementioned embodiments, the first engagement portion 176, 176A is recessed in the mating direction, while the second engagement portion 186, 186A protrudes in the mating direction and is received in the first engagement portion 176, 176A. The present invention is not limited thereto. The conductive member 160, 160A may be configured as follows; the second engagement portion 186, 186A is recessed in the mating direction, while the first engagement portion 176, 176A protrudes in the mating direction and is received in the second engagement portion 186, 186A.

Although the connectors 100, 100A according to the aforementioned embodiments are angled connectors, the present invention is not limited thereto. The present invention is applicable to a straight connector. In other words, the present invention is also applicable to a connector which is mateable with a mating connector in a direction perpendicular to a circuit board when the connector is mounted on the circuit board.

In the aforementioned embodiments, the first portion 170, 170A is, as a whole, thinner than the second portion 180, 180A. Only the first engagement portion 176, 176A may be thinner than the second engagement portion 186, 186A while a part of the first portion 170, 170A other than the first engagement portions 176, 176A may be thicker than a part of the second portion 180, 180A other than the second engagement portions 186, 186A. Furthermore, the first engagement portion 176, 176A may be thicker than the second engagement portion 186, 186A. In other words, in the perpendicular direction, the first engagement portion 176, 176A may have a size greater than a size of the second engagement portion 186, 186A.

The present application is based on a Japanese patent application of JP2015-151912 filed before the Japan Patent Office on Jul. 31, 2015, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST 100, 100A connector
110, 110A structure

115, 115A shell
120, 120A holding member
130, 130A tongue portion
131, 131A end
132, 134, 132A, 134A principal surface
136, 136A hole
140, 150, 140A, 150A terminal
142, 152, 142A, 152A contact portion
144, 154, 144A, 154A fixed portion
160, 160A conductive member
160B blank
170, 170A first portion
172, 172A main portion
174 tab
176, 176A first engagement portion
177 coupling tab
177A bent portion
177B portion
180, 180A second portion
180B side portion
182, 182A lock portion
183, 183A end
184, 184A straight portion
185 receiving portion
185A support portion
186, 186A second engagement portion
186B end
188 coupling portion
190, 190A fixed portion
190B rear end portion
195 modified portion
300 mating connector
310 mating lock portion

The invention claimed is:

1. An electrical connector mateable with a mating electrical connector along a mating direction, wherein:

the electrical connector comprises a holding member, a plurality of terminals and a conductive member;

the holding member has a tongue portion which extends in both a pitch direction and the mating direction, the pitch direction being perpendicular to the mating direction;

each of the terminals is held by the holding member;

each of the terminals has a contact portion; the contact portions of the terminals are arranged in two rows along the pitch direction;

the contact portion of each of the terminals is, at least in part, exposed outside the tongue portion in a perpendicular direction perpendicular to both the mating direction and the pitch direction;

the conductive member is held by the holding member;

the conductive member has a first portion and two second portions, the first portion having a plate-like shape;

the second portions are positioned at opposite ends, respectively, of the first portion in the pitch direction;

the first portion is positioned between the contact portions of the two rows in the perpendicular direction;

the first portion has two first engagement portions;

each of the second portions is partially exposed outside the tongue portion in the pitch direction;

each of the second portions has a second engagement portion; the second engagement portions are engaged with the first engagement portions, respectively;

in the perpendicular direction, the second engagement portion has a size different from a size of the first engagement portion;

the first engagement portion is recessed in the mating direction and the second engagement portion protrudes in the mating direction and is received in the first engagement portion;

the first portion has a main portion and two tabs;

each of the tabs has a male dovetail shape;

a boundary portion between each of the tabs and the main portion is formed with a recess which is recessed along the mating direction;

the recess functions as the first engagement portion;

each of the second portions has a receiving portion;

the receiving portion has a female dovetail shape; the receiving portion is opened inward in the pitch direction, and is recessed outward in the pitch direction;

an opposite edge of the opening of the receiving portion functions as the second engagement portion; and in a state before the conductive member is embedded into the holding member, the first portion is allowed to be moved relative to each of the second portions in the perpendicular direction.

2. An assembly comprising the electrical connector as recited in claim 1 and the mating electrical connector, wherein:

the mating electrical connector has a mating lock portion which is made of metal;

the second portion is provided with a lock portion;

the lock portion extends in the pitch direction and is exposed outside the tongue portion in the pitch direction; and the lock portion locks, together with the mating lock portion, a state where the electrical connector and the mating electrical connector are mated with each other.

3. The electrical connector as recited in claim 1, wherein, in the perpendicular direction, the second engagement portion has a size greater than the size of the first engagement portion.

4. The electrical connector as recited in claim 1, wherein:

in the perpendicular direction, at least one end of the second engagement portion is formed with a modified portion; and the modified portion overlaps with the first engagement portion when projected on a plane perpendicular to the perpendicular direction.

5. The electrical connector as recited in claim 1, wherein:

each of the second portions is distinct and separated from the first portion; and in the perpendicular direction, each of the second portions has a size greater than a size of the first portion.

6. The electrical connector as recited in claim 5, wherein the second portions are connected with the first portion at positions, respectively, each of which is positioned away from each of the first engagement portions and the second engagement portions in the mating direction.

7. The electrical connector as recited in claim 5, wherein each of the first engagement portions and the second engagement portions is positioned outward of the contact portions of the two row in the pitch direction.

8. The electrical connector as recited in claim 1, wherein the first portion and each of the second portions are continuous with each other to form a single component.

9. The electrical connector as recited in claim 1, wherein:

the holding member is a molded product which is made of insulator; and the conductive member is partially embedded in the holding member.

10. The electrical connector as recited in claim 9, wherein:

the tongue portion is formed with a hole which reaches the first portion in the perpendicular direction, and the first portion forms a bottom of the hole; and each of the second portions is exposed outside the tongue portion in the perpendicular direction.

* * * * *